US008728222B2

(12) United States Patent
Kim et al.

(10) Patent No.: US 8,728,222 B2
(45) Date of Patent: May 20, 2014

(54) WET TYPE DUST COLLECTOR FOR VACUUM CLEANER

(75) Inventors: Min-Ha Kim, Gwangju (KR); Joung-Soo Park, Jeonju-si (KR); Heung-Jun Park, Gwangju (KR); Sung-Tae Joo, Gwangji (KR); Dong-Houn Yang, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/401,954

(22) Filed: Feb. 22, 2012

(65) Prior Publication Data

US 2012/0145009 A1 Jun. 14, 2012

Related U.S. Application Data

(63) Continuation of application No. PCT/KR2010/003788, filed on Jun. 11, 2010.

(30) Foreign Application Priority Data

Aug. 26, 2009 (KR) ..... 10-2009-079415

(51) Int. Cl.
*B01D 47/02* (2006.01)

(52) U.S. Cl.
USPC ..... 96/333; 96/347; 96/355; 55/426; 55/DIG. 3

(58) Field of Classification Search
CPC ..... A47L 9/18
USPC ..... 96/336, 338, 342
See application file for complete search history.

(56) References Cited

U.S. PATENT DOCUMENTS

| | | | | |
|---|---|---|---|---|
| 5,776,215 | A * | 7/1998 | Amoretti | 96/247 |
| 2006/0107487 | A1 * | 5/2006 | Tsen | 15/353 |
| 2007/0089610 | A1 * | 4/2007 | Hayashi | 96/317 |
| 2008/0216278 | A1 | 9/2008 | Krebs et al. | |

FOREIGN PATENT DOCUMENTS

| | | | | |
|---|---|---|---|---|
| EP | 1777012 | A2 | 4/2007 | |
| JP | 07-116096 | | 5/1995 | |
| JP | 2007-111397 | A | 5/2007 | |
| KR | 10-2006-0101061 | A | 9/2006 | |
| KR | 20060101061 | * | 9/2006 | A47L 9/10 |
| KR | 10-2008-0003976 | A | 1/2008 | |
| KR | 20080003976 | * | 1/2008 | A47L 9/10 |

OTHER PUBLICATIONS

Machine translation of KR20060101061.*
Machine translation of KR20080003976.*

(Continued)

*Primary Examiner* — Duane Smith
*Assistant Examiner* — Phillip Shao
(74) *Attorney, Agent, or Firm* — NSIP Law

(57) ABSTRACT

A wet type dust collecting apparatus of a vacuum cleaner is provided. The wet type dust collecting apparatus of a vacuum cleaner includes a first separating unit configured to filter out and discharge dust by rotating air which is inlet via a first air inlet, and a plurality of a second centrifugal separating units configured to filter out dust from the air which is discharged from the first separating unit, and configured to eliminate dust from the inlet air via water which is filled inside of the second centrifugal separating units.

18 Claims, 5 Drawing Sheets

(56) References Cited

OTHER PUBLICATIONS

International Search report issued Jan. 24, 2011 in counterpart International application No. PCT/KR2010/003788, 4 Pages including English translation.

European Search Report issued Apr. 18, 2013 in corresponding European Patent Application No. 10812145.0-1712/2471430, PCT/KR2010003788.

* cited by examiner

WET TYPE DUST COLLECTOR FOR VACUUM CLEANER

CROSS-REFERENCE TO RELATED APPLICATIONS

This application is a continuation application under 35 U.S.C. §§120 and 365(c) of PCT Application No. PCT/KR2010/003788 filed on Jun. 11, 2010, which claims the benefit under 35 U.S.C. §119(a) of Korean Patent Application No. 10-2009-079415 filed on Aug. 26, 2009, in the Korean Intellectual Property Office, the entire disclosure of which is incorporated herein by reference for all purposes.

BACKGROUND

1. Field

The following description relates to a wet type dust collecting apparatus for a vacuum cleaner.

2. Description of Related Art

It is well known that a wet dust collecting apparatus may fill water into a dust container and collect dust using the filled water to enhance dust separating efficiency.

Examples of conventional technologies of wet type dust collecting apparatus may include Korean Patent Laid-open No. 2006-101061 (conventional technology 1), Japanese Patent Laid-open No. 07-116096 (conventional technology 2), Korean Patent Registration No. 704336 (conventional technology 3), and U.S. Patent Laid-open No. US2007/0067945 (conventional technology 4).

The conventional technology 1 discloses a dust-collecting tank configured to form a first cyclone chamber, separate dust from water, and provide a filter therein, and a dust collecting apparatus including a corn-shaped second cyclone which is provided on an upper side of a first cyclone and the second cyclone separates dust from air.

The conventional technology 2 discloses a dust collecting apparatus that includes a first separating unit having a corn-shaped cyclone separating apparatus, and a second separating unit having an aqua filter.

The conventional technology 3 discloses a dust collecting apparatus that includes a first cyclone, an aqua filter, and a second cyclone.

The conventional technology 4 discloses a dust collecting apparatus that includes a first dust collecting unit having an aqua filter filled with water, and a dry type dust collecting unit provided with a corn-shaped cyclone.

The conventional technologies described above use water to filter out dust, but the first dust collecting unit or the second dust collecting unit filters out dust in a dry type dust collecting method. In addition, since the second dust collecting unit is composed of a single cyclone, a problem of decreasing dust separating efficiency exists.

Furthermore, in case of the wet type dust collecting apparatus of the above-described conventional technologies, in response to reducing a minor diameter of a centrifugal separating pipe, a water rotation speed becomes faster and dust separating efficiency increases. Thus, dust separating efficiency enhancement and a dust collecting region (wet type dust collecting region) extension is limited.

SUMMARY

According to an aspect, a wet type dust collecting apparatus of a vacuum cleaner is provided. The A wet type dust collecting apparatus of a vacuum cleaner includes a first separating unit configured to filter out and discharge dust by rotating air which is inlet via a first air inlet, and a plurality of a second centrifugal separating units configured to filter out dust from the air which is discharged from the first separating unit, and configured to eliminate dust from the inlet air via water which is filled inside of the second centrifugal separating units.

Air which is inlet to the second centrifugal separating units may be directly contacted to the water which is filled inside of the second centrifugal separating units and rotated so that dust in air is filtered out.

The first separating unit may include a first centrifugal separating pipe which forms a first centrifugal separating region which filters out dust by rotating air which is inlet via the first air inlet, a first dust container which is connected to a lower portion of the first centrifugal separating pipe and configured to collect dust which is filtered out from the first centrifugal separating region with the filled water, and a first discharge pipe unit configured to discharge air where dust is filtered out in the first centrifugal separating region to an outside of the first dust container and the first centrifugal separating pipe. A horizontal cross-section of the first centrifugal separating region may be smaller than a horizontal cross-section of the first dust container.

The apparatus may include a second passage configured to form a connecting passage of the first separating pipe unit and the second centrifugal separating units by forming a first discharge pipe which is connected to the first discharge pipe unit, and a second inlet pipe unit which is installed on each of the second centrifugal separating units so that the second passage is connected to each of the second centrifugal separating units.

The second inlet pipe unit may include an impeller which provides a plurality of impeller ribs in order that air which is inlet via the second passage may be contacted with the water and rotated.

A lower portion of the second inlet pipe unit may be sunk in water which is filled inside of the second centrifugal separating units.

The second centrifugal separating units may include a second discharge pipe, and a second water overflow preventing unit which provides a water overflow preventing rib which is coupled to and fixed on an outer circumference of the second centrifugal separating pipe.

The second water overflow preventing unit may include at least two of the water overflow preventing ribs, the water overflow preventing ribs being formed in concentric circles.

A vertical cross-section of the water overflow preventing rib may have a trapezoidal shape.

The first centrifugal separating pipe may include a first water overflow preventing unit which has a cylindrical shape and protrude toward a first wet type dust collecting region on a bottom of the first centrifugal separating pipe.

The method may include a first water overflow preventing unit which protrudes into a first wet type dust collection region on an upper surface of the first dust container.

The apparatus may include a centrifugal separating assembly formed as one body in order that an upper portion of the first separating unit and upper portions of the second centrifugal separating units may form and connect a first centrifugal separating region and second centrifugal separating regions, and a dust container unit formed as one body in order that a lower portion of the first separating unit and the second separating unit may form a first wet type dust collecting region, and second wet type dust collecting regions configured to collect dust filtered out in the first centrifugal separating region and the second centrifugal separating regions with water.

The second water overflow preventing rib may be a single water overflow preventing rib.

The dust container may have a trapezoidal shape.

In another aspect, a wet type dust collecting apparatus of a vacuum cleaner is provided. The wet type dust collecting apparatus of a vacuum cleaner includes a first centrifugal separating pipe which forms a first centrifugal separating region which filters out dust by rotating air which is inlet via a first air inlet, a first dust container which forms a lower portion of a first wet type dust collecting region which collects dust which is filtered out in the first centrifugal separating region with water, and a first separating unit which provides a first discharge pipe unit configured to discharge air which is inlet from an outside and where dust is filtered out in the first centrifugal separating region to an outside of the first centrifugal separating pipe and the first dust container. A horizontal cross-section of the first centrifugal separating region is smaller than a horizontal cross-section of the first dust container.

The apparatus may include a second centrifugal separating unit configured to filter out dust in the air which is discharged from the first centrifugal separating unit. The air which is inlet into the second centrifugal separating unit may be directly contacted onto water which is filled inside of the second centrifugal separating unit and rotated, thereby eliminating dust.

In another aspect, a wet type dust collecting apparatus of a vacuum cleaner is provided. The wet type dust collecting apparatus of a vacuum cleaner includes a first separating unit configured to filter out and discharge dust by rotating air which is inlet via a first air inlet, and a second centrifugal separating unit configured to filter out dust in the air which is discharged from the first separating unit. The air which is inlet into the second centrifugal separating unit is inlet into a lower portion of a center of the second centrifugal separating unit, and directly contacts the water by being discharged and rotated on a position which is equal to height of filled water so that dust is eliminated.

The apparatus may include an impeller which provides a plurality of impeller ribs in order that air may be discharged to be rotated around the second centrifugal separating unit and the air may be in contact with water directly.

At least a part of the impeller may be sunk in water which is filled inside of the second centrifugal separating unit.

A diameter of a lower portion of the first separating unit may be larger than a diameter of an upper portion of the first separating unit where air which is inlet via the first air inlet is rotated.

In another aspect, a vacuum cleaner is provided. The vacuum cleaner includes a wet type dust collecting unit including a first separating unit configured to filter out and discharge dust by rotating inlet air, and a plurality of a second centrifugal separating units configured to filter out dust from the air discharged from the first separating unit, and configured to eliminate dust from the inlet air via water which is filled inside of the second centrifugal separating units.

Other features and aspects may be apparent from the following detailed description, the drawings, and the claims.

Figure 1:
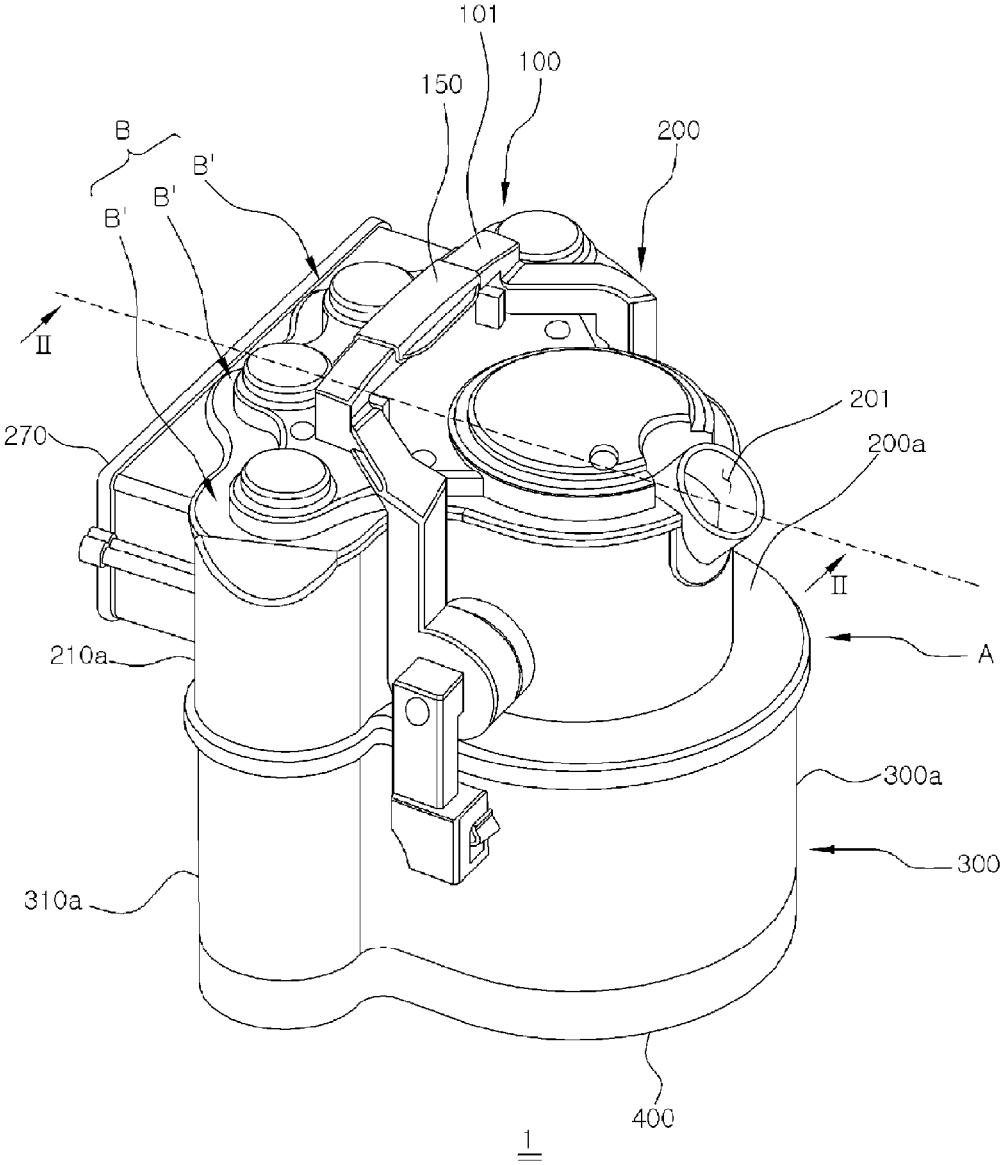
FIG. 1 is a diagram illustrating an example of a wet dust collecting apparatus 1.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

The present invention may be applied to cleaning apparatuses for home, business, and industry.

The present invention overcomes limitations of the above-described conventional technologies, and provides a dust collecting apparatus for a vacuum cleaner to enhance dust separating efficiency.

The present invention also provides a dust collecting apparatus of a vacuum cleaner that extends a dust collecting region and minimizes the overflow of water during an overturning of a dust collecting apparatus, or water overflow in a case of sloppiness.

Figure 2:
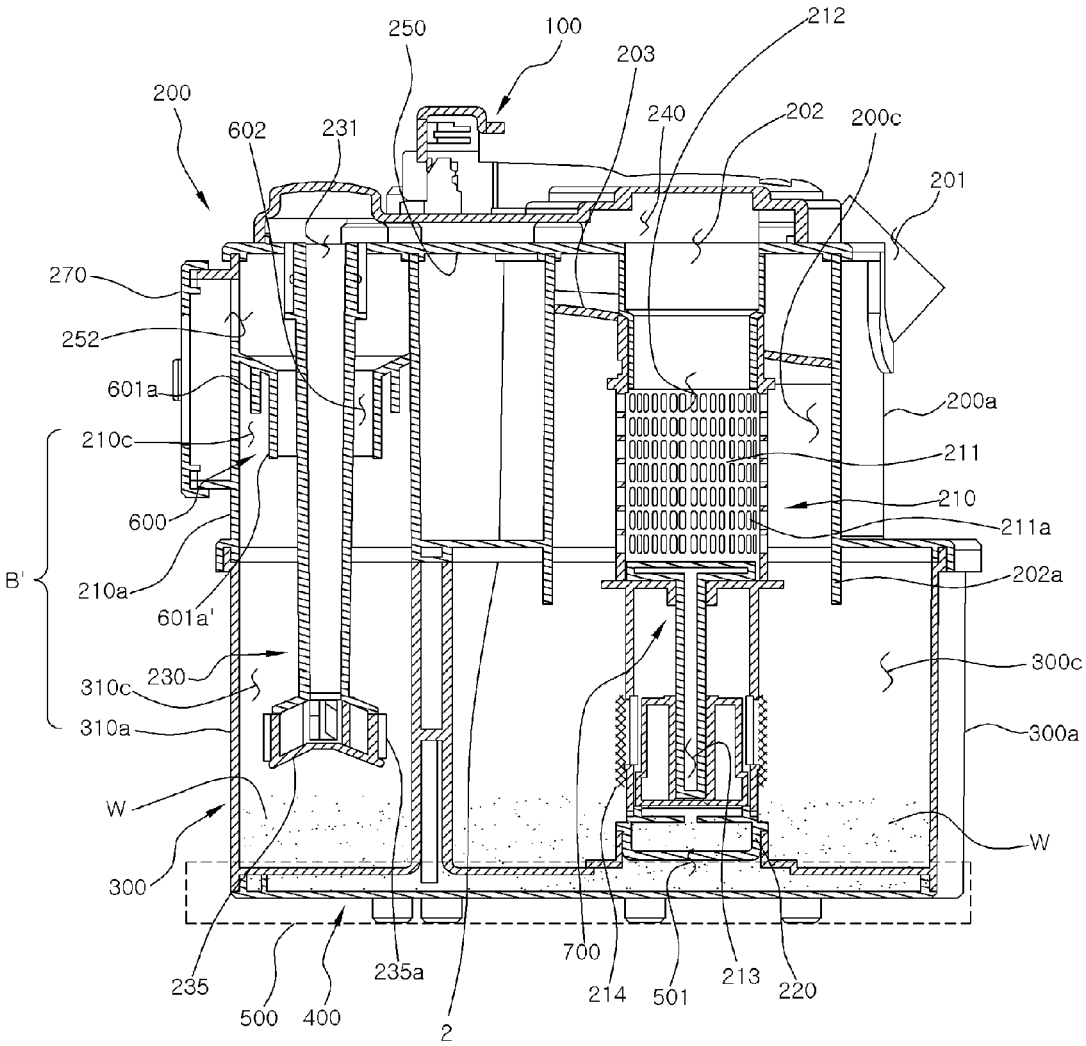
FIG. 2 is a cross-section view illustrating the example of the wet dust collecting apparatus 1 cut along line II-II in FIG. 1.

FIG. 1 illustrates an example of a wet dust collecting apparatus, and FIG. 2 illustrates the example of the wet dust collecting apparatus 1 cut along line II-II in FIG. 1.

The wet dust collecting apparatus 1 includes a centrifugal separating assembly 200 and a dust container unit 300.

The centrifugal separating assembly 200 (see FIG. 2) includes a handle unit 100, a first air inlet 201, a discharge chamber 270, a division wall 250, a first centrifugal separating pipe 200*a*, a first discharge pipe unit 210, a passage preventing member 700, a plurality of second centrifugal separating pipes 210*a* connecting to the discharge chamber 270, a plurality of second inlet pipe units 230, and a second water overflow preventing units 600. The division wall 250 makes an upper portion inside of the dust container unit 300 as a second passage 240 and divides a lower portion inside of the dust container unit 300 into the first centrifugal separating region 200*c* and a plurality of centrifugal separation regions 210*c*.

The handle unit 100 is formed on the centrifugal separating assembly 200, and the handle unit may move the centrifugal separating assembly 200 or mount the centrifugal separating assembly 200 on the dust container unit 300 so that the centrifugal separating assembly 200 may be capable of being fixed or capable of being detached. If the handle unit 100 is located at a point where a coupling of the centrifugal separating assembly 200 and the dust container unit 300 is fixed, the handle unit 100 is fixed so that a handle 101 may not rotated by holder 150.

The first air inlet 201 is formed on one side of the centrifugal separating assembly 200 so that an outer air inlet may be an inlet to the first centrifugal separating region 200*c*. The outer air inlet may be from, for example, a brush assembly (not illustrated) of a vacuum cleaner.

The discharge chamber 270 may cover the second discharge holes 252 on one side of the centrifugal separating assembly 200 where the second discharge holes 252 may discharge air from the second centrifugal separating pipes 210*a*. The second discharge holes 252 may be located inside of the centrifugal separating assembly 200. Based on the above-described configuration, the discharge chamber 270 may collect air discharged via the second discharge holes 252 and discharge the air to a fan motor unit (not illustrated) of a vacuum cleaner (not illustrated).

The division wall 250 includes a first discharge pipe 202 connected to the first discharge pipe unit 210 and the plurality of the second air inlets 231 connected to the plurality of the second inlet pipe units 230. The plurality of the second air inlets 231 are formed on a bottom surface of the division wall 250. The division wall 250 is disposed horizontally inside of an upper portion of the centrifugal separating assembly 200. The division wall 250 may be disposed in a horizontal line. The division wall 250 divides the region of the centrifugal separating assembly 200 into a second passage 240 of an upper portion of the region of the centrifugal separating assembly 200 and a first centrifugal separating region 200*c* and a plurality of second centrifugal separating regions 210*c* of a lower portion of the region of the centrifugal separating assembly 200. The second passage 240 inlets air discharged from the first discharge pipe 202 to the plurality of the second centrifugal separating regions 210*c*. The second passage 240 may be formed by the division wall 250. The second passage 240 may inlet the discharged air from the first discharge pipe 202 via the plurality of second air inlets 231 and the second inlet pipe unit 230.

The first centrifugal separating pipe 200*a* is formed to limit the first centrifugal separating region 200*c*. The first centrifugal separating region 200*c* separates large and heavy dust from an outer air inlet via the first air inlet 201. A vertical section of the first centrifugal separating pipe 200*a* may be formed in a variety of shapes such as a square shape, trapezoidal shape, or an inverted trapezoidal shape.

The first centrifugal separating pipe 200*a* is disposed on a bottom surface of the division wall 250 so that the first discharge pipe 202 may be connected to the upper portion of the first centrifugal separating pipe 200*a*. In addition, on a bottom surface of the first centrifugal separating pipe 200*a*, a first water overflow preventing unit 202*a* caved in from the pipe bottom surface is formed.

The first discharge pipe unit 210 may be formed with a cylindrical shape and may include a guide 203, a grill 211, and a sealing member 220.

The guide 203 may protrude in a spiral shape on an upper outer circumference of the first discharge pipe unit 210 and guide rotation of inlet air.

The grill 211 may have a plurality of discharge pipes 211*a*. The plurality of discharge pipes 211*a* may filter out dust included in discharge discharged via the first discharge pipe unit 210 and the plurality of discharge pipes 211*a* may be formed in a center of the first discharge pipe unit 210.

The sealing member 220 may be coupled to a bottom surface of the first discharge pipe unit 210.

The first discharge pipe unit 210 may be coupled to the bottom surface of the division wall 250. The first discharge pipe unit 210 may be connected to the second passage 240 via the first discharge pipe 202 within the first centrifugal separating pipe 200*a*. Thus, the first discharge pipe unit 210 may be connected to the centrifugal separating assembly 200.

In response to the centrifugal separating assembly 200 being connected to the dust container unit 300, the sealing member 220 may be coupled to the water discharge pipe 501 of the water discharge passage unit 500. Accordingly, the sealing member 220 may divide the water discharge passage unit 500 and the first wet type dust collecting region 300*c*.

The passage preventing member 700 is installed inside of the first discharge pipe unit 210. The passage preventing member 700 may prevent water W from being inlet inside of a vacuum cleaner (not illustrated) via the first discharge pipe unit 210.

Each of the plurality of second centrifugal separating pipes 210*a* may have a cylindrical shape. The second discharge holes 252 connected to the discharge chamber 270 may be formed respectively on one side of an upper portion of each of the second centrifugal separating pipes 210*a*. In addition, the plurality of the second centrifugal separating pipes 210*a* may have a smaller inside diameter than the first centrifugal separating pipe 200*a*. The second centrifugal separating pipes 210*a* may separate fine dust not separated by the first centrifugal separating pipe 200*a*.

The second centrifugal separating pipes 210*a* may be coupled to the bottom surface of the division wall 250 in order to include the second air inlet 231. The second centrifugal separating pipes 210*a* may limit the second centrifugal separating region 210*c*.

The plurality of the second centrifugal separating pipes 210*a* may be disposed on a side of the first centrifugal separating pipe 200*a* and have an integrated shape.

The second inlet pipe units 230 may have a cylindrical shape and may be opened in an upper and a bottom portion of the second inlet pipe units 230.

The second inlet pipe units 230 may include an impeller 235 having an impeller rib 235*a*. The impeller rib 235*a* may be curved at a predetermined angle, and have a plurality of holes formed on the bottom region of the second inlet pipe units 230. The second inlet pipe units 230 may be coupled to the bottom surface of the division wall 250 so that the second inlet pipe units 230 may be connected to the second passage 240 via the second air inlet 231. The second air inlet 231 may be disposed inside of each of the second centrifugal separating regions 210*c*, and the second inlet pipe units 230 may be disposed respectively on a center portion of the cylinder shape second centrifugal separating pipes 210*a*. In response to the second inlet pipe units 230 being disposed respectively on the center portion of the second centrifugal separating pipes 210*a*, at least a part of the impeller 235 is sunk in a center portion of water W. The water W may be filled inside of the second centrifugal separating region 210*c*. A level of the impeller 235 and depth of water may be verified. In other words, the impeller 235 may be disposed to be completely or partly underwater. In addition, the bottom portion of the impeller 235 may be disposed to be in contact with a surface of water W or a little detached from the surface of water W. As another aspect, at least a part of the impeller 235 is underwater or disposed on the surface of water to contact air discharged via the impeller 235 with water directly and rotating the air to increase a surface in contact with the water to separate fine dust, and to transmit a suction force generated by a suction motor (not illustrated) to the first centrifugal separating region 200*c* via the impeller 235 efficiently. The impeller 235 may make air discharged via the second inlet pipe units 230 move to a lower portion of a center of the second inlet pipe units 230. The discharged air may be rotated and disposed on around the center of the second inlet pipe units 230. Accordingly, the air of the second centrifugal separating region 210*c* may be in contact with water of the second wet type dust collecting region 310*c* so that dust is separated from air and the water is rotated.

The second water overflow preventing unit 600 may include a plurality of water overflow preventing ribs 601*a* and 601*a*' that form a concentric circle, and the plurality of water overflow preventing ribs 601*a* and 601*a*' may have a cylindrical shape toward a lower direction. The second water overflow preventing unit 600 may have a larger inside diameter than an external diameter of the second inlet pipe unit 230, and an external diameter of the second water overflow preventing unit 600 may correspond to an inside diameter of the second centrifugal separating pipe 210*a*. The second water overflow preventing unit 600 may be disposed around an outer circumference of the second inlet pipe units 230 to form a second discharge passage 602. Then, the second water overflow preventing unit 600 may be located on a bottom portion of the second discharge holes 252 and fixed inside of the second centrifugal separation pipes 210*a*.

The dust container 300 (see FIG. 2) includes a first dust container 300*a*, a plurality of the second dust containers 310*a*, and a sub-cover 400 forming a water discharge passage unit 500. The water discharge passage unit 500 may connect bottom surfaces of the first dust container 300*a* and the second dust container 310*a*.

The first dust container 300*a* includes the first wet type dust collecting region 300*c* collecting dust with rotating water W. A vertical cross-section of the first dust container 300*a* may have a rectangular shape, a trapezoidal shape, and an inverted trapezoidal shape.

The second dust containers 310*a* may form a plurality of the second wet type dust collecting regions 310*c* collecting dust with rotating water W. The second dust containers 310*a* may form the second wet type dust collecting regions 310*c*. The second wet type dust collecting regions 310*c* may be formed in a line along a side of the first dust container 300*a* on a location facing a bottom surface of each of the second centrifugal separating pipes 210*a*.

To fill water W in the first wet type dust collecting region 300*c* and the second wet type dust collecting regions 310*c*, a bottom surface of the first wet type dust collecting region 300*c* and a bottom surface of the second wet type dust collecting regions 310*c* are connected to each other via a water discharge passage unit 500. A conventional configuration of the water discharge passage unit 500 is understood by one of ordinary skill in the art, so a description thereof is omitted for conciseness.

The centrifugal separating assembly 200 is connected to an upper portion of the dust container unit 300 to form the wet type dust collecting apparatus 1.

In response to the centrifugal separating assembly 200 being coupled to an upper portion of the dust container 300, the first centrifugal separating pipe 200*a* may be inserted into an inside of the first dust container 300*a*. At this time, the sealing member 220 is coupled to the water discharge pipe 501 to separate the water discharge passage unit 500 and the first wet type dust collecting region 300*c*.

The first water overflow preventing unit 202*a* may protrude in a lower direction from a bottom surface of the first centrifugal separating pipe 200*a* and prevent water W rotating inside of the first wet type dust collecting region 300*c* from overflowing onto the grill 211. The first wet type dust collecting region 300*c* may be formed by the first dust container 300*a*. Accordingly, the water W filled in the first wet type dust collecting region 300*c* is prevent from being inlet to the second passage 240 or the second centrifugal separating unit B' (see FIG. 2). In addition, the first water overflow preventing unit 202*a* may protrude toward an inside of the first wet type dust collecting region 300*c* on an upper surface of the first dust container 300*a*.

In response to the centrifugal separating assembly 200 being coupled to the dust container unit 300, the second inlet pipe units 230 may also be inserted into the second centrifugal separating pipes 210*a* facing the second inlet pipe units 230, respectively.

In response to the centrifugal separating assembly 200 being coupled to the dust container unit 300, the first centrifugal separating pipe 200*a* and the first dust container 300*a* which are coupled to each other form the first separating unit A.

In addition, each of second centrifugal separating pipe 210*a* and corresponding second dust containers 310*a* form a second centrifugal separating unit B', respectively. Each of the second centrifugal separating units B' separates fine dust not separated in the first separating unit A respectively. All of the second centrifugal separating units B' form the second separating unit B. The second separating unit B separates dust such as fine dust not separated by the first separating unit A.

As described above, in response to the centrifugal separating assembly 200 being coupled to the dust container unit 300 and turning the handle unit 100 into 'lock' position in order to maintain a state where the centrifugal separating assembly 200 is coupled to the dust container unit 300, a fixing unit and a hook unit are coupled to each other so that the centrifugal separating assembly 200 and the dust container unit 300 may not be separated from each other.

As described above, in response to the coupled wet type dust collecting apparatus 1 being mounted on a vacuum cleaner (not illustrated), the discharge chamber 270 is coupled to a passage connected to a fan motor unit (not illustrated) of the vacuum cleaner (not illustrated). In addition, the first air inlet 201 is coupled to an inlet passage (not illustrated) connected to a brush assembly body (not illustrated). Accordingly, the wet type dust collecting apparatus 1 forms a passage for air flow inside of a vacuum cleaner (not illustrated).

In response to the vacuum cleaner being operated in the above state, air inlet from an outside is inlet to the first centrifugal separating region 200*c* via the first air inlet 201.

The air inlet inside of the first centrifugal separating region 200*c* rotates around the first discharge pipe unit 210. In response to the air rotating around the first discharge pipe unit 210, water W filled in the first wet type dust collecting region 300*c* of the first dust container 300*a* by rotation force of the air is also rotated. Accordingly, a centrifugal force filters out dust in the first centrifugal separating region 200*c*, and dust filtered out by rotating water W is collected in the first wet type dust collecting region 300*c*.

In the process, in response to water W getting faster and water W level rising along an interior wall of the first dust container 300*a*, the first water overflow preventing unit 202*a* and a raised spot 2 block out water W of the first dust container 300*a* to be inlet to the grill 211.

The first water overflow preventing unit 202*a* and the raised spot 2 minimize water overflow in the wet type dust collecting apparatus 1.

The air where dust is filtered out is inlet to the second passage 240 via the grill 211 and the first discharge pipe unit 210. Rotating water W and centrifugal force generated by air rotation in the first separating unit A filters dust out of the air.

The air inlet via the second passage 240 is inlet to the second wet type dust collecting regions 310*c* via the plurality of second air inlets 231 and the second centrifugal separating pipes 210*a*. The plurality of second air inlets 231 may be formed on the division wall 250, and the second centrifugal separating pipes 210*a* may be connected to the second air inlets 231. At this time, the air inlet to the second wet type dust collecting regions 310*c* may be discharged to be rotated in one direction by the impeller 235. Accordingly, water W filled in the second wet type dust collecting regions 310*c* is rotated. The water W rotating in the second wet type dust collecting regions 310*c* may collect dust with its own viscosity and polarity and apply centrifugal force to fine dust included in the air discharged in the water W, thereby efficiency of filtration and collection of fine dust may be enhanced.

Where water W filled in the second wet type dust collecting regions 310*c* filters out the air, the air flows in an upper direction and is discharged to the discharge chamber 270 via the second discharge passages 602 and the second discharge pipes 252. The second discharge passages 602 and the second discharge pipes 252 is formed by the second centrifugal separating pipes 210*a* and the second water overflow preventing units 600.

At this time, the second water overflow prevention units 600 prevent droplets generated from the water W rising along an interior wall of the second centrifugal separating pipes 210*a* from being disposed toward an outside via the second discharge passages 602. The droplets are prevented from being generated due to rotation of the water W or the water W rotating in the second centrifugal separating regions 210*c*.

Figure 3:
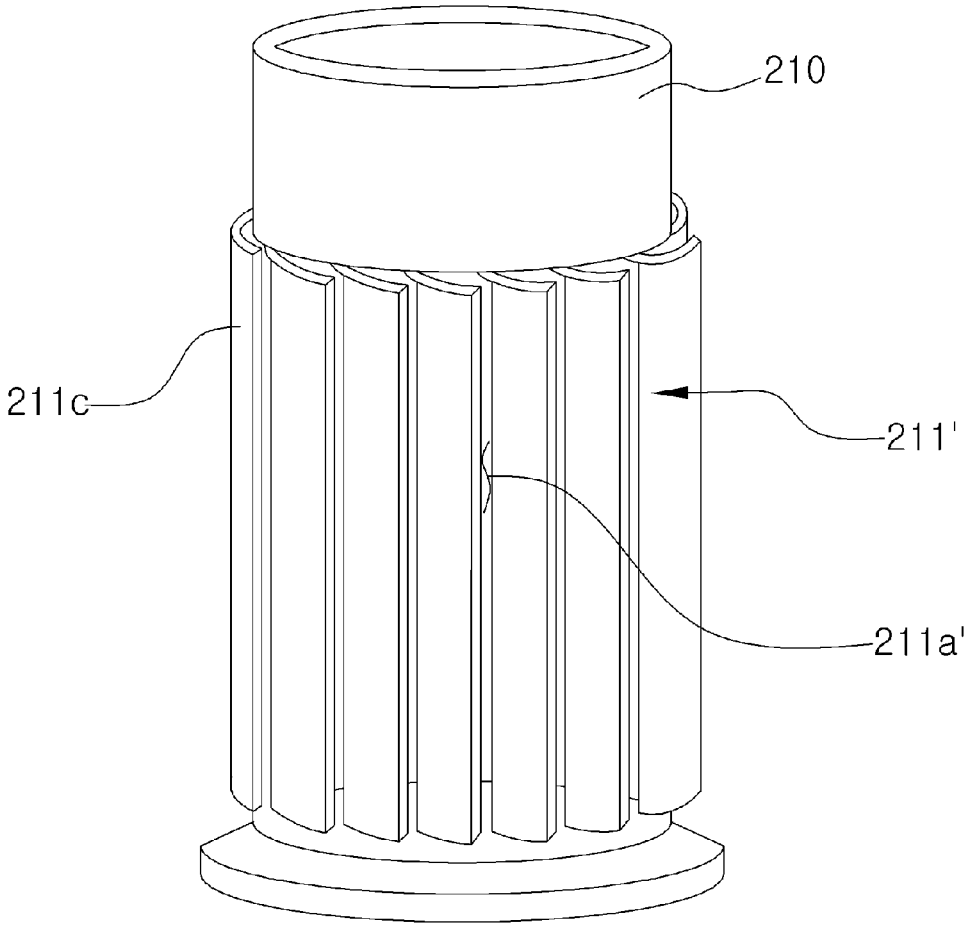
FIG. 3 is a diagram illustrating another example of a grill 211'.

FIG. 3 illustrates another example of a grill 211'. The first discharge pipe unit 210 includes a grill 211' that includes flaps 211*a*' and 211*c*' that are opened and closed, respectively.

Figure 4:
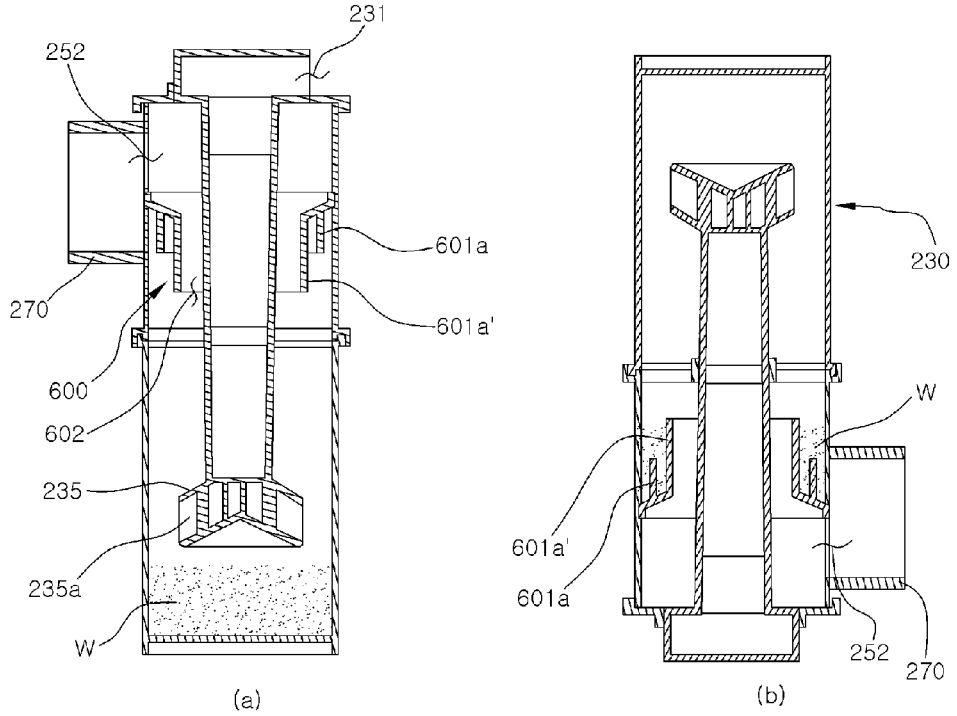
FIG. 4 is a diagram illustrating a second centrifugal separating unit B' showing a state where water overflow is prevented by a second water overflow preventing unit 600 when the wet dust collecting apparatus 1 in FIG. 1 is overturned.
Figure 5:
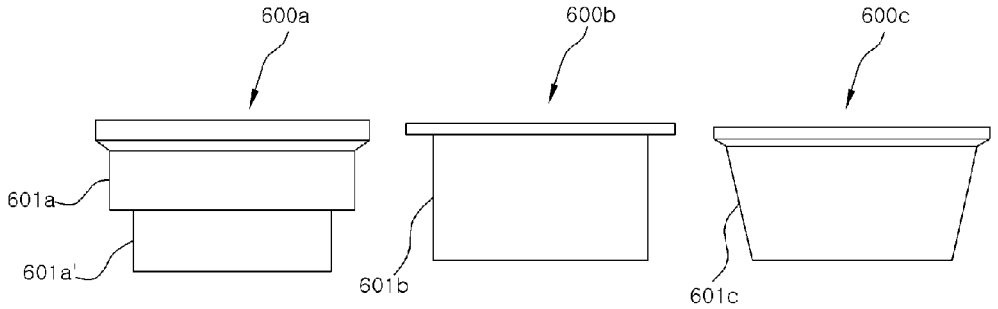
FIG. 5 is a diagram illustrating another example of the second water overflow preventing units in FIG. 2.

In addition, even when the second water overflow preventing units 600 is overturned, the second water overflow preventing units 600 prevents inner water W from being outlet to the outside of the second water overflow preventing units 600 via the second discharge passages 602 and the second discharge hole 252. FIG. 4 illustrates the second centrifugal separating unit B' where water overflow is prevented by the second water overflow preventing units 600 in response to the wet type dust collecting apparatus 1 of FIG. 1 being overturned. (a) of FIG. 4 illustrates the second centrifugal separating unit B' in a normal state, and (b) of FIG. 4 illustrates the second centrifugal separating unit B' in an overturned state. As illustrated in (b) of FIG. 4, even when the wet type dust collecting apparatus 1 is overturned, the water W outlet to an outside is prevented by the water overflow preventing ribs 601*a* and 601*a*' of the second water overflow preventing units 600. FIG. 5 illustrates other examples of the second water overflow preventing units 600 of FIG. 2. The second water overflow preventing units 600 may have diverse configurations. For example, a second water overflow preventing unit 600*a* may have double water overflow preventing ribs 601*a* and 601*a*' as illustrated in (a) of FIG. 5. A second water overflow preventing unit 600*b* may have single water overflow preventing rib 601*b* as illustrated in (b) of FIG. 5. A second water overflow preventing unit 600*c* may have a trapezoidal shape of a vertical section as illustrated in (c) of FIG. 5.

Figure 6:
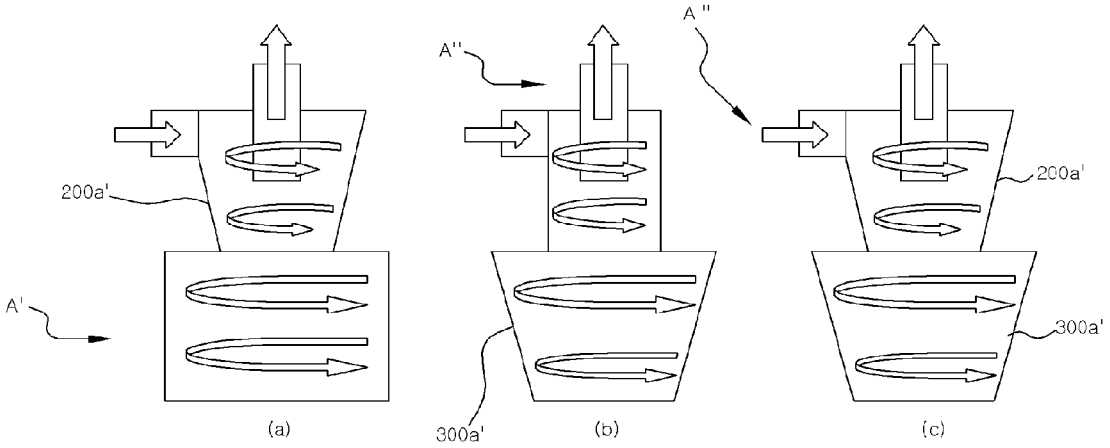
FIG. 6 is a diagram illustrating other examples of first separating units A', A", and A'" of the first separating unit A in FIG. 2.

FIG. 6 illustrates other examples of first separating units A', A", and A'" of the first separating unit A in FIG. 2.

As illustrated in (a) of FIG. 6, the first separating unit A in FIG. 2 may include the first centrifugal separating unit A' including the first centrifugal separating pipe 200*a*' having a trapezoidal shape whose lower portion of a vertical cross section is narrower than in an upper portion of the vertical cross section, a first centrifugal separating unit A" formed of a first dust container 300*a*' having a trapezoidal shape whose lower portion of a vertical cross section is narrower than in an upper portion of the vertical cross section as illustrated in (b) of FIG. 6, and a first separating unit A'" formed of a first centrifugal separating pipe 200*a*' having a trapezoidal shape whose lower portion of a vertical cross section is narrower than in an upper portion of the vertical cross section as illustrated in (c) of FIG. 6, and a first dust container 300*a'*.

At this time, dust separating efficiency of the first separating unit A' in (a) of FIG. 6 may be increased. In addition, a mixing degree of water and dust of the first separating unit A" in (b) of FIG. 6 may be increased. Dust separating efficiency and mixing degree of water and dust of the first separating unit A'" in (c) of FIG. 6 may be also increased.

In the wet type dust collecting apparatus 1, a horizontal cross-section of the first centrifugal separating pipe 200*a* is smaller than a horizontal cross section of the first dust container 300*a*. The first centrifugal separating pipe 200*a* may be disposed on an upper portion of the first dust container 300*a* collecting dust separated by rotating water.

The centrifugal separating pipe of a wet type dust collecting apparatus of a conventional technology may separate dust by using centrifugal force of the configuration and operation In other words, the wet type dust collecting apparatus 1 makes a horizontal cross-section of the first centrifugal separating pipe 200*a* small and enhances a rotational force of air (increase centrifugal force), thereby dust separating efficiency may be enhanced. In addition, the wet type dust collecting apparatus 1 increases a cross section of the first dust container 300*a* to increase a surface area of water. Thus, dust separating efficiency is increased as a probability of contact of water and dust is increased. Accordingly, overall separating efficiency of the wet type dust collecting apparatus 1 may be enhanced.

In addition, the wet type dust collecting apparatus 1 makes a horizontal cross section of the first centrifugal separating pipe 200*a* smaller than a horizontal cross section of the first dust container 300*a*. Accordingly, the raised spot 2 prevents water W inlet from the first wet type dust collecting region 300*c* to the first centrifugal separating region 200*c*. The raised spot 2 has a predetermined width and is formed on a connecting unit of the first centrifugal separating pipe 200*a* and the second dust containers 310*a*.

Furthermore, the first water overflow preventing unit 202*a* is formed on a bottom surface of the first centrifugal separating pipe 200*a*. Accordingly, water rotating inside of the first dust container 300*a* being inlet to the inside of the first centrifugal separating region 200*c* may be further prevented.

The wet type dust collecting apparatus 1 having the above described configuration and functions operate in a dry type dust collecting apparatus when water W is not filled in the wet type dust collecting apparatus 1.

A wet type dust collecting apparatus increases an area contacting water and time of water contact, thereby enhancing dust separation and collection, by making air passing the wet type dust collecting apparatus contact water at least two times.

The present invention allows air inlet to the second centrifugal separating region to contact water directly and rotate, thereby separation efficiency of fine dust and dust separating efficiency of a dust collecting apparatus are enhanced.

The present invention has a horizontal cross section of an upper centrifugal separating region among dust separating regions within a dust collecting apparatus smaller than a horizontal cross section of a wet type dust collecting region. The wet type dust collecting region performs a wet type dust collecting by rotating water in the lower portion of the dust collecting apparatus. Accordingly, the present invention minimizes water overflow and enhances dust separating efficiency.

The present invention minimizes water overflow even when water rotates inside of a dust collecting apparatus and the dust collecting apparatus is tilted by applying a water overflow preventing unit to the dust collecting apparatus.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A wet type dust collecting apparatus of a vacuum cleaner, the apparatus comprising:

a first separating unit configured to filter out and discharge dust by rotating air which is inlet via a first air inlet, the first separating unit comprising an upper portion in which air circulates and a lower portion in which water circulates, wherein an interior wail of the upper portion comprises a horizontal cross-section that is narrower than a horizontal cross-section of an interior wall of the lower portion;

an overflow prevention which protrudes from the interior wall of the lower portion and which prevents water that rises up the interior wall of the lower portion due to centrifugal force from contacting air in the upper portion; and a plurality of a second centrifugal separating units configured to filter out dust from the air which is discharged from the first separating unit, and configured to remove dust from the inlet air via water which is filled inside of the second centrifugal separating units.

2. The apparatus as claimed in claim 1, wherein air which is inlet to the second centrifugal separating units is directly contacted to the water which is filled inside of the second centrifugal separating units and rotated so that dust in air is filtered out.

3. The apparatus as claimed in claim 1, wherein the first separating unit comprises:

a first centrifugal separating pipe which forms a first centrifugal separating region which filters out dust by rotating air which is inlet via the first air inlet;

a first dust container which is connected to a lower portion of the first centrifugal separating pipe and configured to collect dust which is filtered out from the first centrifugal separating region with the filled water; and a first discharge pipe unit configured to discharge air where dust is filtered out in the first centrifugal separating region to an outside of the first dust container and the first centrifugal separating pipe, wherein a horizontal cross-section of the first centrifugal separating region is smaller than a horizontal cross-section of the first dust container.

4. The apparatus as claimed in claim 3, further comprising:

a second passage configured to form a connecting passage of the first separating pipe unit and the second centrifugal separating units by forming a first discharge pipe which is connected to the first discharge pipe unit; and a second inlet pipe unit which is installed on each of the second centrifugal separating units so that the second passage is connected to each of the second centrifugal separating units.

5. The apparatus as claimed in claim 4, wherein the second inlet pipe unit further comprises:

an impeller which provides a plurality of impeller ribs in order that air which is inlet via the second passage may be contacted with the water and rotated.

6. The apparatus as claimed in claim 4, wherein a lower portion of the second inlet pipe unit is sunk in water which is filled inside of the second centrifugal separating units.

7. The apparatus as claimed in claim 1, wherein the second centrifugal separating units further comprise:

a second discharge pipe; and a water overflow preventing unit which provides a water overflow preventing rib which is coupled to and fixed on an outer circumference of the second centrifugal separating pipe.

8. The apparatus as claimed in claim 7, wherein the water overflow preventing unit includes at least two of the water overflow preventing ribs, the water overflow preventing ribs being formed in concentric circles.

9. The apparatus as claimed in claim 7, wherein a vertical cross-section of the water overflow preventing rib has a trapezoidal shape.

10. The apparatus as claimed in claim 3, wherein the first centrifugal separating pipe further comprises:

a first water overflow preventing unit which has a cylindrical shape and protrudes toward a first wet type dust collecting region on a bottom of the first centrifugal separating pipe.

11. The apparatus as claimed in claim 3, further comprising:

a first water overflow preventing unit which protrudes into a first wet type dust collection region on an upper surface of the first dust container.

12. The apparatus as claimed in claim 1, further comprising:

a centrifugal separating assembly formed as one body in order that an upper portion of the first separating unit and upper portions of the plurality of second centrifugal separating units may form and connect a first centrifugal separating region and second centrifugal separating regions; and a dust container unit formed as one body in order that a lower portion of the first separating unit and the second separating unit may form a first wet type dust collecting region; and second wet type dust collecting regions configured to collect dust filtered out in the first centrifugal separating region and the second centrifugal separating regions with water.

13. A wet type dust collecting apparatus of a vacuum cleaner, the apparatus comprising:

a first centrifugal separating pipe which forms a first centrifugal separating region which filters out dust by rotating air which is inlet via a first air inlet;

a first dust container which forms a lower portion of a first wet type dust collecting region which collects dust which is filtered out in the first centrifugal separating region with water;

an overflow prevention which protrudes from an interior wall of first dust container and which prevents water that rises up the interior wall of the first dust container due to centrifugal force from contacting air in the first centrifugal separating pipe; and a first separating unit which provides a first discharge pipe unit configured to discharge air which is inlet from an outside and where dust is filtered out in the first centrifugal separating region to an outside of the first centrifugal separating pipe and the first dust container, wherein a horizontal cross-section of an interior wall of the first centrifugal separating pipe is smaller than a horizontal cross-section of the interior wall of the first dust container.

14. The apparatus as claimed in claim 13, further comprising:

a second centrifugal separating unit configured to filter out dust in the air which is discharged from the first centrifugal separating unit, wherein the air which is inlet into the second centrifugal separating unit is directly contacted onto water which is filled inside of the second centrifugal separating unit and rotated, thereby eliminating dust.

15. A wet type dust collecting apparatus of a vacuum cleaner, the apparatus comprising:

a first separating unit configured to filter out and discharge dust by rotating air which is inlet via a first air inlet, the first separating unit comprising an upper portion in which air circulates and a lower portion in which water circulates, wherein an interior wall of the upper portion comprises a horizontal cross-section that is narrower than a horizontal cross-section of an interior wall of the lower portion;

an overflow prevention which protrudes from the interior wall of the lower portion and which prevents water that rises up the interior wall of the lower portion due to centrifugal force from contacting air in the upper portion; and a second centrifugal separating unit configured to filter out dust in the air which is discharged from the first separating unit, wherein the air which is inlet into the second centrifugal separating unit is inlet into a lower portion of a center of the second centrifugal separating unit, and directly contacts the water by being discharged and rotated on a position which is equal to height of filled water so that dust is eliminated.

16. The apparatus as claimed in claim 15, further comprising:

an impeller which provides a plurality of impeller ribs in order that air may be discharged to be rotated around the second centrifugal separating unit and the air may be in contact with water directly.

17. The apparatus as claimed in claim 16, wherein at least a part of the impeller is sunk in water which is filled inside of the second centrifugal separating unit.

18. The apparatus as claimed in claim 15, wherein a diameter of a lower portion of the first separating unit is larger than a diameter of an upper portion of the first separating unit where air which is inlet via the first air inlet is rotated.

* * * * *